US005235768A

United States Patent [19]

Eder

[11] Patent Number: 5,235,768

[45] Date of Patent: Aug. 17, 1993

[54] DOUBLE FACED CHANGEABLE SIGN

[75] Inventor: John R. Eder, Prospect, Ky.

[73] Assignee: Diversified Advertising, Inc., Louisville, Ky.

[21] Appl. No.: 759,475

[22] Filed: Sep. 13, 1991

[51] Int. Cl.[5] ..... G09F 7/00

[52] U.S. Cl. ..... 40/488; 40/597; 40/907

[58] Field of Search ..... 40/488, 490, 491, 5, 40/597, 907; 434/405

[56] References Cited

U.S. PATENT DOCUMENTS

| | | | |
|---|---|---|---|
| 2,683,946 | 7/1954 | Olson | 40/490 |
| 3,769,727 | 11/1973 | Kent, Jr. | 40/488 |
| 4,217,713 | 8/1980 | Greenberger | 40/488 |
| 4,654,990 | 4/1987 | Suters | 40/491 |
| 4,953,315 | 9/1990 | Romaine | 40/488 X |

*Primary Examiner*—Kenneth J. Dorner
*Assistant Examiner*—J. Bonifanti
*Attorney, Agent, or Firm*—Middleton & Reutlinger

[57] ABSTRACT

A double faced changeable sign having a sliding panel to conceal or reveal messages, wherein the sign is removably mounted to a transparent window or other clear surface.

9 Claims, 3 Drawing Sheets

DOUBLE FACED CHANGEABLE SIGN

BACKGROUND OF THE INVENTION

The present invention relates to a double faced changeable sign to be removably secured to store windows or in door windows and display a message on both sides of the glass. Changeable signs currently known in the art require several moving parts, are limited in the number of messages displayed, and/or are for a dedicated use.

It is the objective of the present invention to provide a device for the retailer to indicate hours of operation and open or closed status, via a small unobstructive double faced changeable sign which is removably secured to a glass door or window.

SUMMARY OF THE INVENTION

A double faced changeable sign for mounting to a glass surface of a door, comprising a base panel, a sliding cover panel movably attached to the base panel, a stop means for limiting the movement of the sliding cover panel on the base panel, a means for removably attaching the sign to a window or other flat transparent surface, wherein the front of the base panel, the back of the base panel, or the front of the slidable cover panel, or each of them or all of them, includes indicia for displaying at least one selected message.

BRIEF DESCRIPTION OF THE DRAWINGS

A better understanding of the present invention will be had upon reference to the following description in conjunction with the accompanying drawings in which like numerals refer to like parts throughout the several views and wherein.

SPECIFICATION

Figure 1:
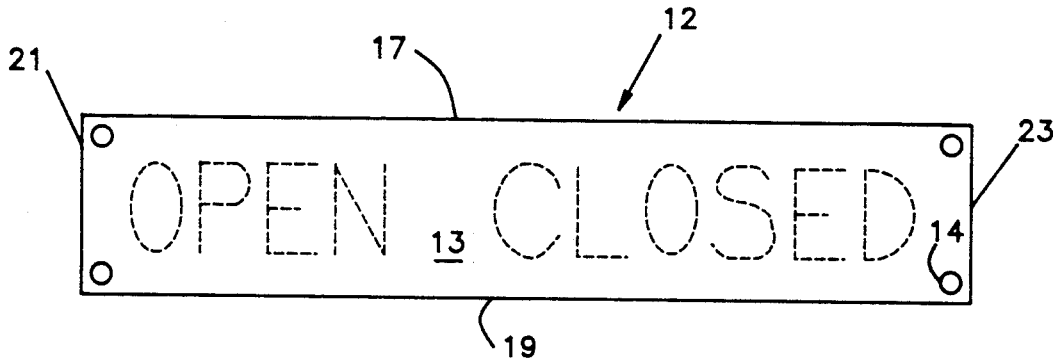
FIG. 1 is a front view of the base panel displaying in phantom lines the message "OPEN" and "CLOSED".

The double faced changeable sign of the present invention is manufactured from readily available materials and simple in design. The sign is designed having a base panel supporting a sliding cover panel which covers a portion of the base panel. The base panel and sliding cover panel may be constructed of metal, cardboard, or plastic. The double faced changeable sign of the preferred embodiment is extruded from clear plastic, specifically polystyrene.

In the preferred embodiment, the base panel 12 is fashioned from extruded polystyrene plastic forming a thin strip or sheet, rectangular in shape and uniform in thickness. The size, weight and thickness of the sheet is arbitrary and determined by the user's requirements. The base panel 12 shown in FIGS. 1 and 2 has a front 13, back 15, top edge 17, bottom edge 19, and as viewed from the front 13, a left edge 21, and a right edge 23.

Figure 3:
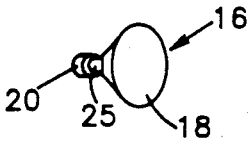
FIG. 3 is a perspective view of a suction cup such as is used to removably secure the sign to the window glass.
Figure 4:
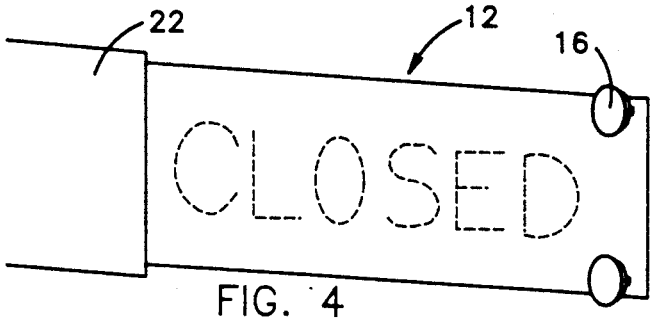
FIG. 4 is a perspective view showing the suction cup of FIG. 3 affixed to the base panel of FIG. 1.

FIG. 3 shows the suction cups 16 having a dish portion 18 which attaches to a flat surface, a stem 25, and a flared end 20 which is larger in diameter than the stem 25. The suction cups 16 are made of clear soft plastic and are sized to the dimensions and weight of the overall sign. The suction cups 16 are affixed to one side of the base panel 12 to removably secure the double faced changeable sign 10 to the surface of a window. As illustrated in FIG. 4, suction cups 16 serve as a means of attachment of the sign 10 to a window or some other flat, clear surface.

Figure 2:
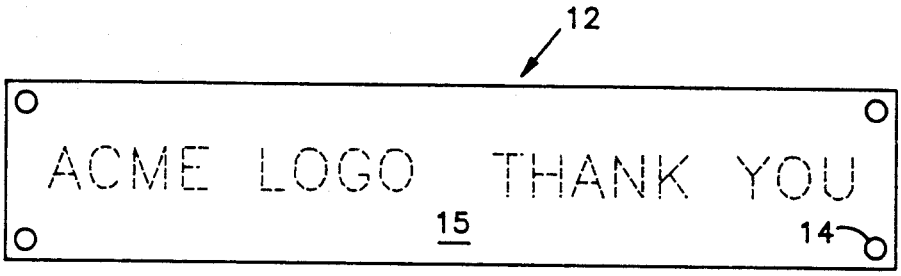
FIG. 2 is a rear view of the base panel of FIG. 1 displaying in phantom lines the message "OPEN" and "CLOSED".
Figure 5:
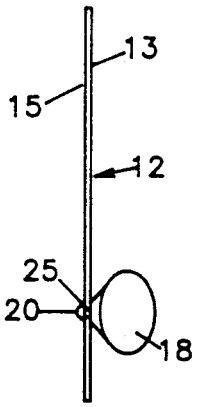
FIG. 5 shows a side view of the suction cups of FIG. 3 affixed to the base panel of FIG. 1, wherein the flared end of the suction cup protrudes from the back of the base panel and the dish of the suction cup extends from the front of the base panel.

As shown in FIG. 1 and 2, each of the four corners of the base panel 12 is drilled or punched to create holes 14 extending through the base plate 12. The holes 14 are sized to accommodate the stem 25 of the suction cups 16. The suction cups 16 are affixed to the base plate 12 so that the stem 25 protrudes through the holes 14 of the base plate 12, the dish portion 18 extends from the front 13 of the base plate 12, and the flared ends 20 project from the back 15 of the base plate 12 as best shown in FIG. 5. The sign 10 attaches to the window surface on the inside and faces outward to display the primary message through the window.

Figure 6:
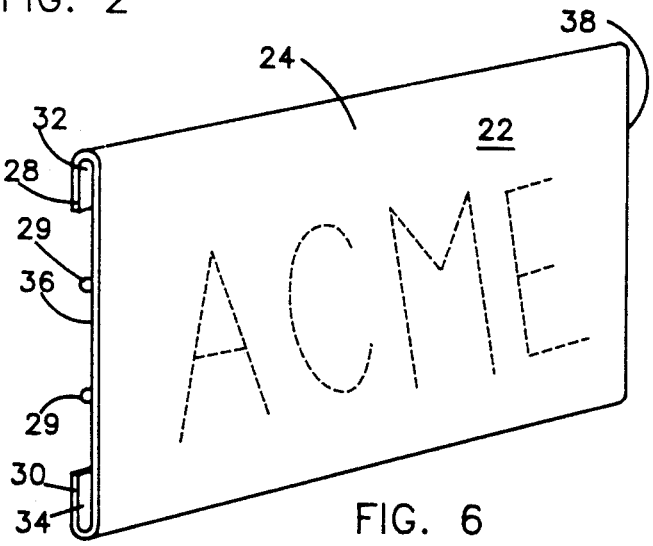
FIG. 6 shows a perspective view of the sliding cover panel and "C-shaped" channels therein.
Figure 7:
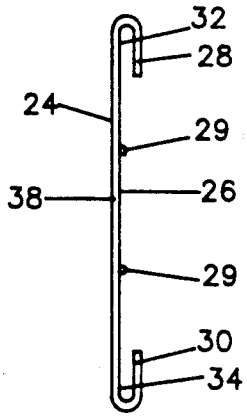
FIG. 7 shows a side view of the sliding cover panel of FIG. 6 and the "C-shaped" channels therein.

In the preferred embodiment, the sliding cover panel 22 is fashioned from extruded polystyrene plastic forming a thin strip or sheet, rectangular in shape and uniform in thickness which is sized with respect to the base panel 12. As best shown in FIGS. 4 and 5, the sliding cover panel 22 has a front 24 and back 26, and an upper and lower flange 28 and 30 respectively, extending along the top and bottom edge of the panel forming a pair of "C-shaped" channels 32 and 34 respectively, along the back 26 of the sliding cover panel 22, wherein the "C-shaped" channels 32 and 34 are open at both ends. When viewed from the front 24, the left side edge 36 and right side edge 38 of the sliding cover panel 22 are open. The top and bottom edges 17 and 19 respectively of the base panel 12 is inserted within the "C-shaped" channels 32 and 34 in a slidable relationship within the "C-shaped" channels 32 and 34 wherein the base panel 12 is held in the "C-shaped" channels 32 and 34 by flanges 28 and 30. In addition, as best revealed in FIGS. 6 and 7, the slidable cover 22 includes upper and lower spacer means or ridges 29, preferably extending the full length of slidable cover 22 which permits the slidable cover to slide along the longitudinal axis of base panel 12 without binding.

The flared ends 20 of the suction cups 16 extend from the back 15 of the base panel 12 and contact the left side edge 36 and right side edge 38 of the sliding cover panel 22 to provide a stop means and prevent the sliding cove panel 22 from sliding off of the base panel 12. The sign 10 may be designed so that the dish 18, stem 25, or flared ends 20 of the suction cups 16 serve as a stop means for the sliding movement of the sliding cove panel 22 along the base panel 12.

In the preferred embodiment, the sliding cover panel 22 is sized to be approximately one half the length of the base panel 12 so that the front 24 extends only partially over the base panel 12. This facilitates the display of one or more messages to be printed on the base panel 12 so that the sliding cover panel 22 may be moved by sliding from end to end, or left to right to a position covering or exposing a particular message or portion thereof which is displayed on the base panel 12. The sliding cover panel 22 may be easily removed and replaced with other sliding cover panels 22 having different messages and also be positioned quickly and conveniently to display a desired portion of the message.

Figure 8:
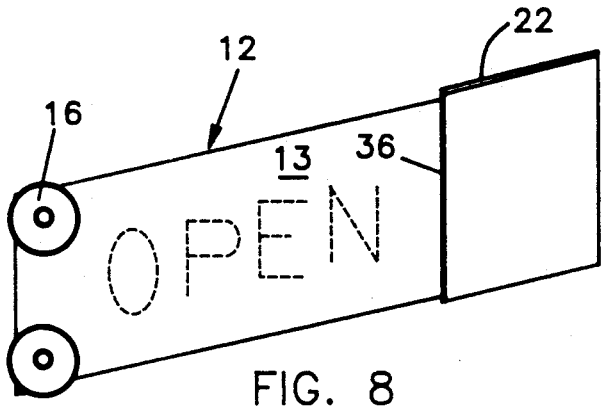
FIG. 8 shows a perspective view of the front of the base panel of FIG. 1 wherein the sliding cover panel of FIG. 6 has been moved to the right to display the message "OPEN" in phantom lines.
Figure 9:
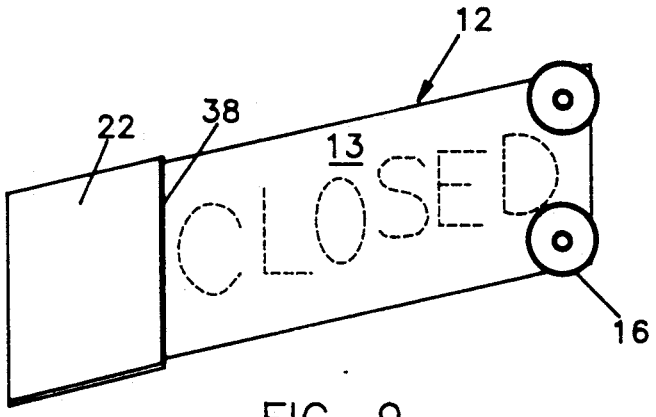
FIG. 9 shows a perspective view of the front of the base panel of FIG. 1 wherein the sliding cover panel of FIG. 6 has been moved to the left to display the message-"CLOSED" in phantom lines.

The primary message displayed by the sign 10 is on the front 13 of the base panel 12 which is the outward facing surface of the sign 10 with respect to the store window. As shown in FIGS. 8 and 9 in phantom lines, the message displayed on the front 13 of the base panel 12 may indicate on one end that the business is "open" and on the opposite end of the front 15 that the business is "closed". The sliding cover panel 22 can be positioned to display the proper message on the front 13 of the base panel 12 by moving the sliding cover panel 22 to leave exposed either the "open" or "closed" message.

As shown in FIG. 2 in phantom lines, a message may be displayed o the front 24 of the sliding cover panel 22 to indicating store hours, the name of the business establishment or some type of advertisement.

Figure 10:
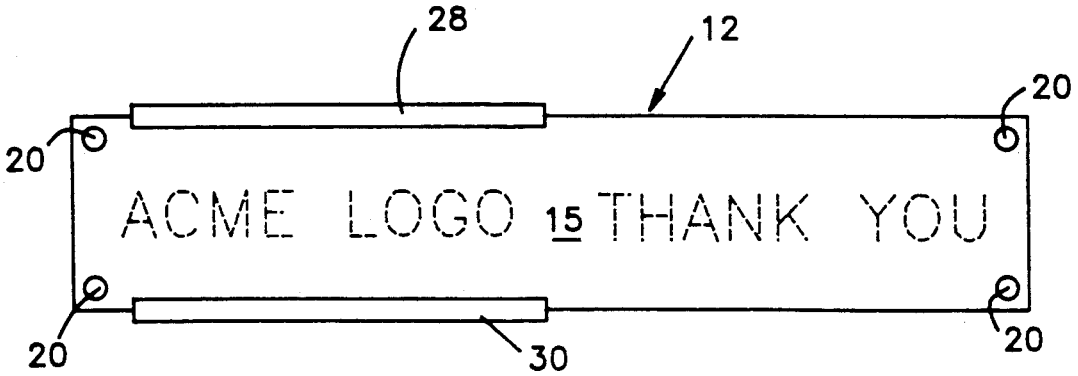
FIG. 10 shows a rear view of the back of the base plate and back of the sliding cover panel with the flared end stop means, wherein the message "ACME LOGO" and "THANK YOU" is displayed in phantom lines.
Figure 11:
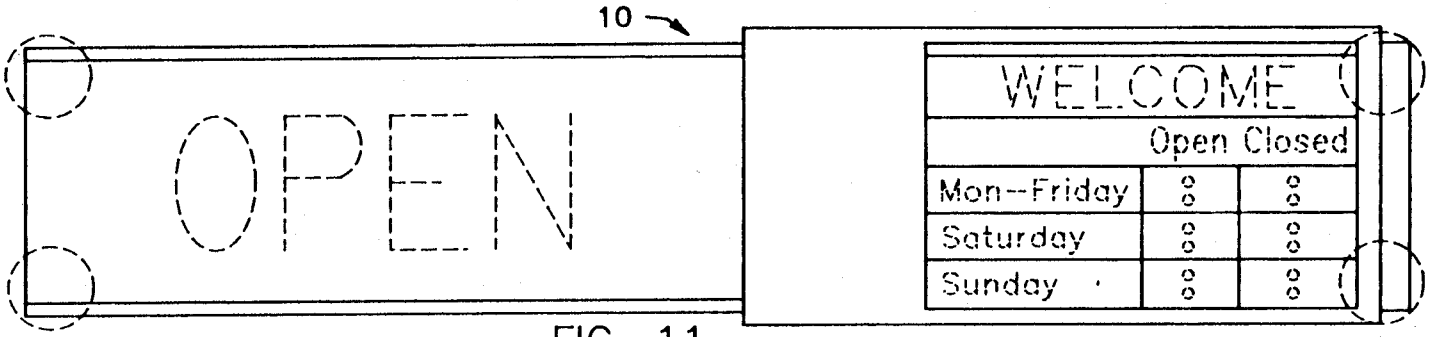
FIG. 11 shows a front elevantional view of the complete sign of the present invention showing the message "Open" imprinted on the base plate and also showing the message "Welcome" plus business hours displayed on the movable sliding panel.
Figure 12:
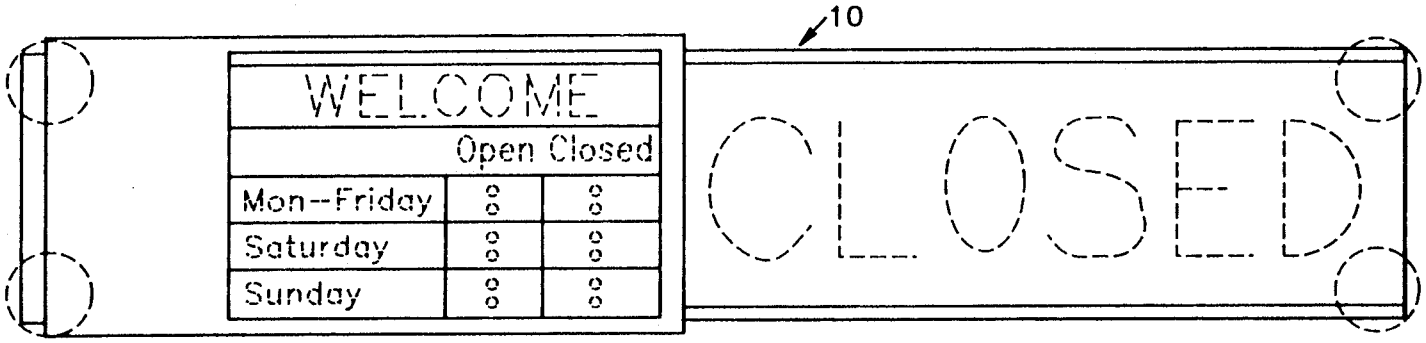
FIG. 12 shows the sign depicted in FIG. 11, but with the slidable panel located at its left-most position, thereby revealing the message "Closed" on the base panel, and covering the "Open" message.
Figure 13:
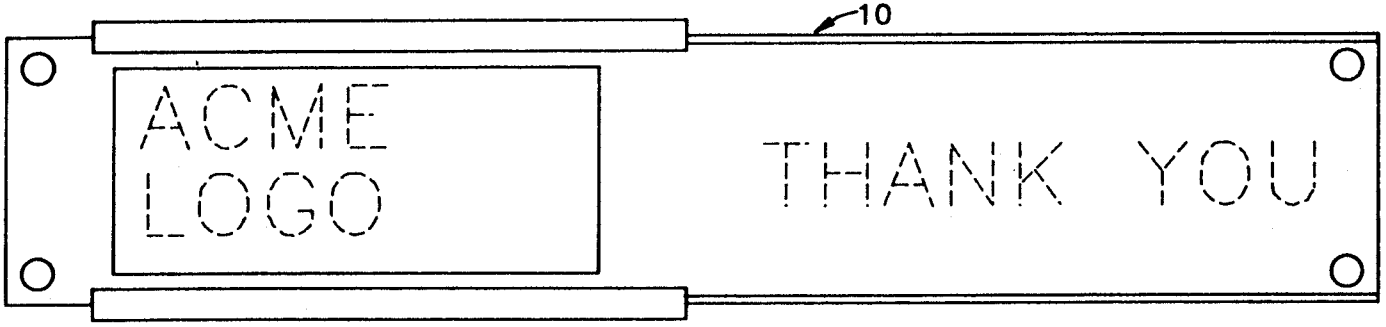
FIG. 13 shows the reverse side of the sign depicted in FIG. 11, showing that the left-most portion of the rear of the base plate is capable of revealing a message indicative of the logo or trademark of the sign owner, and the right-most portion of the rear of the base plate is capable of displaying a message such as "Thank You For Your Business".

One of the most important and features of the instant invention is the novel design of the sliding cover panel 22 so that the "C-shaped" panels 32 and 34 hold the sliding cover panel 22 in position with respect to the base panel 12, and provide an unobstructed view of the back 15 of the base panel 12 a shown in FIG. 10. The flat "C-shaped" channels 32 and 34 formed by flanges 28 and 30 leave the back 15 of the base panel 12 exposed regardless of the position of the movement of the sliding cover panel 22 from left or right. This provides a means for displaying an additional message on the back 15 of the base panel 12 as shown in phantom lines in FIG. 10. Also, as mentioned above, the spacer means 29 are important to prevent binding as the slidable cover is moved along the base panel to display different desired message(s).

The foregoing detailed description is given primarily for clearness of understanding and no unnecessary limitations are to be understood therefrom for modification will become obvious to those skilled in the art upon reading this disclosure and may be made upon departing from the spirit of the invention and scope of the appended claims.

I claim:

1. A double faced changeable sign, comprising:

a base panel comprising a generally thin, flat, elongated strip of material, having a front side, a back side, a top side edge, a bottom side edge, a left side edge, and a right side edge, said base panel being provided with two indicia display areas disposed thereon along the length of said front side and said rear side;

a sliding cover panel movably attached to said base panel comprising a generally thin, flat, rectangular strip of material of uniform thickness, having a front side, a back side, a left side edge, a right side edge, a top edge, and a bottom edge, said top and bottom edges being bent backward and inward toward one another forming a pair of flanges defining generally "C-shaped" channels extending along a portion of the top edge and bottom edge of said back side of said sliding cover panel, said "C-shaped" channels being open at both ends, said top and bottom edges of said base panel being removably insertable and movably held into position within said "C-shaped" channels in a slidable relationship by said flanges of said "C-shaped channels", said sliding cover panel covering only a portion of said front side of said base panel being slidable and movable from end to end of said base panel, said front side of said sliding cover panel having indicia disposed thereon covering or exposing a selected portion of said front side of said base panel providing an unobstructed view of the uncovered portion of said front of said base panel, said sliding cover panel being slidably positioned relative to said base panel in order to coordinate indicia between said front side of said sliding cover panel and said front side of said base panel, said "C-shaped" channels providing an unobstructed view of said indicia disposed on said back side of said base panel said indicia remaining visible along the entire length of said back side of said base panel;

at least one raised ridge spacer running substantially the full length of said back side of said sliding cover panel limiting binding between said back side of said sliding cover plate and the surface of said front side of said base panel;

a stop means for limiting the movement of said sliding cover panel along said base panel; and suction cup mounting means for removably attaching said sign to a flat transparent surface.

2. The double faced changeable sign as recited in claim 1, wherein said base panel is constructed of clear plastic.

3. The double faced changeable sign as recited in claim 1, wherein said sliding cover panel is constructed of clear plastic.

4. The double faced changeable sign as recited in claim 1, wherein said stop means is a suction cup.

5. The double faced changeable sign as recited in claim 1, wherein said suction cup comprises a dish portion, a stem, and a flared end.

6. The double faced changeable sign as recited in claim 5, wherein said dish portion of said suction cup extends outwardly from said front side of said base panel for removably securing said double faced changeable sign to a flat surface.

7. The double faced changeable sign as recited in claim 6, wherein said said stem protrudes through said base panel holes, said dish portion extends outwardly frontward from said front side of said base plate, and said flared ends extend outwardly rearward from said back side of said base plate.

8. The double faced changeable sign as recited in claim 7, wherein said stop means for limiting the movement of said sliding cover panel along said base panel comprises said flared ends of said suction cups contacting said side edges of said slidable cover panel.

9. The double faced changeable sign as recited in claim 1, wherein said base panel having a plurality of holes therein is in cooperative relationship with said stem of said suction cup.

* * * * *